US006860530B2

(12) United States Patent
Senn

(10) Patent No.: US 6,860,530 B2
(45) Date of Patent: Mar. 1, 2005

(54) BAR LOCK MECHANISM

(75) Inventor: Brian A. Senn, South Milwaukee, WI (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/364,105

(22) Filed: Feb. 11, 2003

(65) Prior Publication Data

US 2004/0155470 A1 Aug. 12, 2004

(51) Int. Cl.[7] ..... E05C 19/08

(52) U.S. Cl. ..... 292/285; 292/259 R; 292/281; 292/286; 292/DIG. 32; 292/DIG. 71

(58) Field of Search ..... 292/285, 286, 292/281, 259 R, DIG. 71, DIG. 32

(56) References Cited

U.S. PATENT DOCUMENTS

| | | | | | |
|---|---|---|---|---|---|
| 968,190 | A | * | 8/1910 | Patch | 292/210 |
| 1,571,899 | A | * | 2/1926 | Haseltine | 49/277 |
| 1,755,581 | A | * | 4/1930 | Haseltine | 292/68 |
| 1,919,328 | A | * | 7/1933 | Hansen | 292/218 |
| 2,195,620 | A | * | 4/1940 | Ditchfield | 292/285 |
| 2,196,294 | A | * | 4/1940 | Dwyer | 49/219 |
| 2,243,872 | A | * | 6/1941 | Le Beau | 292/285 |
| 2,297,007 | A | * | 9/1942 | Lounsbury | 292/241 |
| 2,298,259 | A | * | 10/1942 | Dunham | 292/218 |
| 3,281,177 | A | * | 10/1966 | Tenenbaum | 292/241 |
| 3,370,877 | A | * | 2/1968 | Hallberg | 292/285 |
| 3,378,294 | A | * | 4/1968 | Olander | 292/218 |
| 3,434,751 | A | * | 3/1969 | Chieger et al. | 292/218 |
| 3,464,729 | A | * | 9/1969 | Chambers | 292/218 |
| 3,695,661 | A | * | 10/1972 | Pastva | 292/218 |
| 3,891,112 | A | * | 6/1975 | Lycett et al. | 220/1.5 |
| 3,933,384 | A | * | 1/1976 | Schuller et al. | 292/285 |
| 4,068,409 | A | * | 1/1978 | White | 49/367 |
| 4,134,281 | A | | 1/1979 | Pelcin | |
| 4,397,488 | A | * | 8/1983 | Pastva | 292/210 |
| 4,483,557 | A | * | 11/1984 | Pastva | 292/218 |
| 4,844,524 | A | * | 7/1989 | Pastva | 292/218 |
| 5,046,770 | A | * | 9/1991 | Hansen | 292/218 |
| 5,314,218 | A | * | 5/1994 | Nadherny | 292/256.5 |
| 5,562,316 | A | | 10/1996 | Bullock et al. | |
| 5,718,466 | A | * | 2/1998 | Weinerman et al. | 292/218 |
| 6,053,545 | A | | 4/2000 | Asmundson et al. | |

FOREIGN PATENT DOCUMENTS

| | | | |
|---|---|---|---|
| FR | 2686645 | * | 1/1992 |

* cited by examiner

*Primary Examiner*—John Walsh
*Assistant Examiner*—Carlos Lugo
(74) *Attorney, Agent, or Firm*—John W. Harbst

(57) ABSTRACT

A bar lock mechanism for releasably securing a pivoted door in a closed position relative to an opening in a walled enclosure and including an elongated shaft structure connected to the walled enclosure and defining an axis of rotation for the bar lock mechanism. A locking handle is connected to the shaft structure for rotating the shaft structure and securing the door in the closed position. A pair of axially spaced hinge pieces are adapted to be disposed at opposed end portions of the shaft structure. Each hinge piece has a base portion for allowing securement of the hinge piece to the walled enclosure and an integral portion spaced from the base portion for journalling a respective end of the shaft structure for rotation about its axis whereby allowing the bar lock mechanism to move relative to the walled enclosure.

19 Claims, 2 Drawing Sheets

BAR LOCK MECHANISM

FIELD OF THE INVENTION

The present invention generally relates to a door closing mechanism and, more particularly, to a bar lock mechanism for releasably securing a door in a closed position relative to an opening in a walled enclosure.

BACKGROUND OF THE INVENTION

Many trucks, truck trailers, cargo and/or freight containers, tankers and like vehicles typically have a walled enclosure which is provided with an opening in at least one wall thereof to allow loading and unloading of the vehicle or container. Conventionally, a door is hinged along one side for swinging movements into the plane of the wall for releasably closing the opening. A gasket seal is commonly arranged in combination with such door to inhibit moisture, dust, dirt, debris and related contaminating elements from passing between the door and the walled enclosure and entering through the opening when the door is closed.

To maintain the door in a closed position, a bar lock device or assembly is known to be provided between the door and the walled enclosure. Such a bar lock device is usually fabricated from several separate components or pieces which are typically welded together. For example, a conventional bar lock device includes an elongated body pivotally mounted to the walled enclosure of the vehicle and has pivotally mounted along the length thereof a locking handle. The locking handle is adapted to coact with a latch or lock on the door to hold the door in the closed position. The elongated body of such bar lock devices usually includes a piece of elongated round or flat stock having at least two hinge barrels, sometimes referred to as straps, welded thereto in axially spaced relation from each other. Coaxially arranged hinge butts, secured to the walled enclosure, are operably coupled to the elongated body. Typically, a pair of individual pins pivotally interconnect the hinge butts to the hinge barrels or straps on the elongated bar. Alternatively, a pair of hinge assemblies are used to pivotally attach the elongated body to the walled enclosure. Each such hinge assembly typically include two hinge pieces or elements secured to each other by a pivot pin. In this arrangement, one hinge piece or element is secured to the walled enclosure while the other hinge piece or element of the hinge assembly is secured to the elongated body of the bar lock mechanism.

A clevis-like mounting member is typically welded along the length of the elongated shaft or bar to allow the locking handle to be pivotally secured to the elongated body. As will be appreciated, and largely because of their different shapes and sizes, welding a single hinge butt to the walled enclosure will require different techniques than welding a hinge assembly to the walled enclosure which is still different than welding a clevis-like mounting member to an elongated shaft or bar. Moreover, and as will be discussed below, the orientations of the parts relative to each other also differ, thus, further complicating the assembly process.

To enhance the ability of the gasket to seal about the marginal edge of the door, a bar lock device is frequently designed to apply a compressive force against an outer surface of the door when the locking handle is arranged in operable combination with the latch to hold the door closed. When a separate locking handle bracket is welded to the elongated round or flat stock, tolerance variations coupled with inadvertent but inescapable human errors in repetitively locating the respective components in their respective fixtures leads to inconsistent angular orientations and differences between the respective parts. If the tolerance variations and accumulation of errors are extreme or excessive, the compressive force exerted by bar lock device on the door and, thus, on the gasket seal may be inadequate for the intended purpose. Accordingly, there may be leakage between the gasket and the walled enclosure which can lead to contaminants, i.e., moisture, dust, dirt and debris, entering the walled enclosure through the opening. Moreover, when the pressure exerted by the bar locking device against the door is inadequate, premature wear on the door, door hinges, gaskets and related components can result from excessive vibration between the door and walled enclosure. On the other hand, when excessive tolerance variations cause the door lock device to exert too much pressure against the door, the operator can have difficulty in securing the handle lock in locked relation with the lock on the door.

Thus, there is a need and continuing desire for an improved bar lock mechanism for holding a door in a closed position, which is strong, simple in construction, and economical to manufacture.

SUMMARY OF THE INVENTION

In view of the above, and in accordance with one aspect, there is provided a bar lock mechanism for releasably securing a pivoted door in a closed position relative to an opening in a walled enclosure. The bar lock mechanism includes an elongated shaft structure connected to the walled enclosure for rotation about an axis spaced from and extending parallel with an edge of the door and arranged opposite to a pivotal axis about which the door moves and a locking handle connected to the shaft structure for rotating the shaft structure and releasably securing the door in the closed position. A pair of axially spaced hinge pieces are adapted to be disposed at opposed ends of the shaft structure. Each hinge piece has a base portion configured to allow the hinge piece to be secured to the walled enclosure and a mounting portion for journalling a respective end of the shaft structure for rotation about an axis whereby allowing the bar lock mechanism to move relative to the walled enclosure.

According to another aspect, there is provided bar lock mechanism for releasably securing a door in a closed position wherein the door extends across an opening defined by a walled enclosure. As is known, the door is swingable about a generally vertical axis disposed adjacent a first vertical marginal edge of the opening. The bar lock mechanism includes an elongated member defining an elongated axis extending between opposed ends thereof and about which the bar lock mechanism swingably moves and a manually operated locking handle connected to and about midlength of the elongated member. The handle is connected to the member for rotation about an axis extending generally normal to the elongated axis to allow the handle to be manipulated into operable locking relation with a lock carried on the door. Hinge structure is operably associated with opposed ends of the elongated member for pivotally securing the bar lock mechanism to the walled enclosed adjacent a second vertical marginal edge of the opening. The hinge structure includes a pair of axially spaced hinge pieces, with one hinge piece being disposed in association with each end of the elongated member. Each hinge piece is configured to secure a respective end of the elongated member for rotation about the elongated axis whereby allowing the bar lock mechanism to swingably move toward and away from the door.

According to this aspect, each hinge piece of the hinge structure includes a base portion and a mounting portion integrally interconnected to each other. The base portion of each hinge piece is configured to facilitate mounting of the hinge piece to the walled enclosure.

According to another aspect, there is provided a closure mechanism for releasably closing and securing a door swingably movable between open and closed positions relative to an opening in a body of a vehicle. The closure mechanism includes hinge structure including a pair of axially spaced, generally coaxial pivot elements secured to the body of the vehicle adjacent a marginal edge of the opening and an axially elongated shaft for selectively coupling the door to the pivot elements. The shaft is mounted between and journalled for rotation by the pivot elements and defines an elongated axis about which the shaft pivots. A locking handle is pivotally mounted on and between opposed ends of the elongated shaft for manual movement, with the handle being movable between an open position and a closed position relative to a lock mounted on the door.

In a preferred embodiment, the bar lock mechanism further includes compressible structure for allowing the bar lock mechanism to exert a compressive closing force against the door. In one form, the compressible structure is arranged in laterally spaced relation from the elongated axis about which the bar lock mechanism swingably or pivotally moves and in confronting relation relative to an outer surface of the door, when said door is in the closed position, for urging said door toward the closed position.

In one form, the mounting portion of the hinge piece has a cup-like configuration for accommodating an end of the elongated member or shaft. Preferably, the mechanism further includes bearing structure interposed between the elongated member or shaft and the mounting portion of each hinge piece wherein the elongated shaft or member is seated for rotation. Because such hinge structure is exposed to atmospheric elements, and to avoid other problems, the cup-like configuration on the hinge piece is preferably designed to allow draining thereof In another form, the elongated member of the bar lock mechanism is hollow or has recesses which open to opposed ends of the elongated member. In this form, a pivot pin is arranged in operable combination with the base portion of each hinge piece. While the base portion of each hinge piece is configured to facilitate mounting the hinge piece to the walled enclosure, the pivot pin is configured to project into the open end of the shaft whereby mounting the elongated member for rotation relative to the walled enclosure.

An object of the present invention is to provide an improved bar locking mechanism for securely maintaining a movable door within a plane of an associated walled enclosure.

Another object of this invention is to provide a bar locking mechanism for securing a swingable door in a closed position but having fewer parts than heretofore known devices whereby maintaining simplicity while reducing the cost to manufacture such a mechanism.

These and other objects, aims and advantages of the subject invention will be understood and better appreciated from the following detailed description, appended claims and drawings.

DETAILED DESCRIPTION OF THE INVENTION

Figure 1:
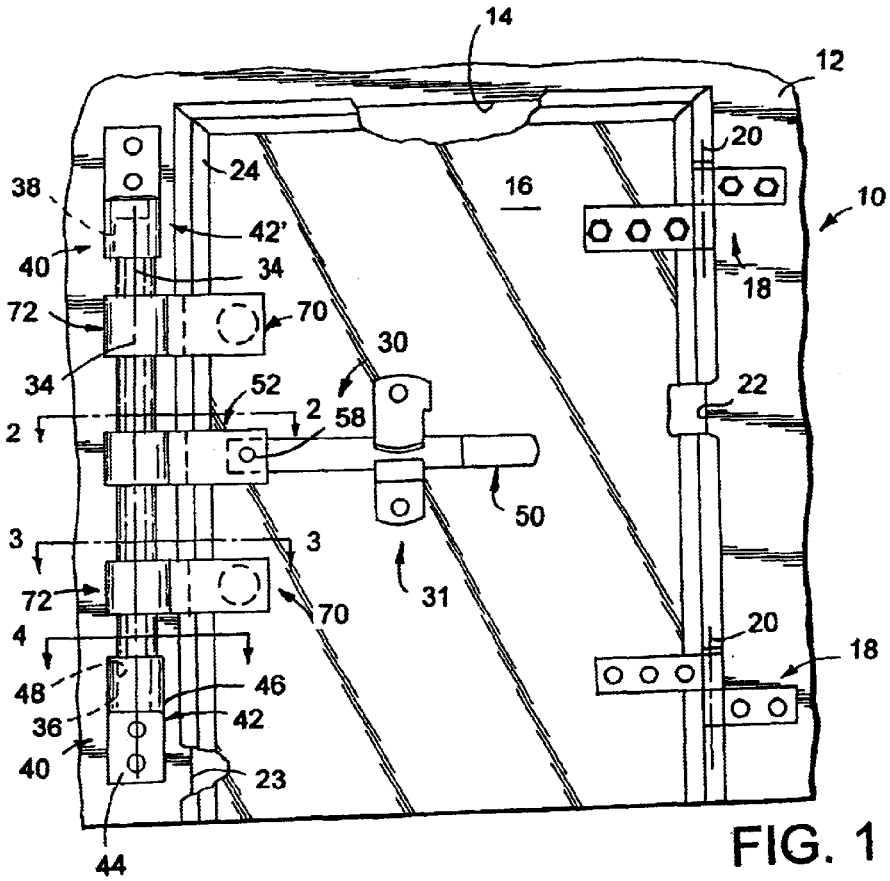
FIG. 1 is an elevational view of a walled enclosure or container having an opening and a door which is releasably held closed by a bar lock mechanism according to the present invention.

The present invention is susceptible of embodiment in multiple forms, and there is shown in the drawings and will hereinafter be described preferred embodiments of the invention, with the understanding the present disclosure sets forth exemplifications of the invention which are not intended to limit the invention to the specific embodiments illustrated and described.

Referring now to the drawings, wherein like reference numerals indicate like parts throughout the several views, there is shown in FIG. 1 a conventional transport vehicle or container, generally identified by reference numeral 10, having a walled body or enclosure 12 defining an opening 14. As is typical, a door 16 is mounted by conventional hinge structure 18 along a vertical edge for swinging movement about a generally vertical axis 20 disposed adjacent a first vertical marginal edge 22 of the opening 14 to allow the door 16 to move into an out of the plane of the walled body 12 whereby releasably closing the opening 14.

In the embodiment shown, door 16 is preferably flat, substantially rectangular and metal clad. Preferably, marginal edges of the opening 14 are overlapped by an outer peripheral flange 24 (FIG. 2) provided about the relevant edges of the door 16. Moreover, and as shown in FIG. 2, seal structure 26 is preferably provided and adapted to operatively cooperate with the exterior of the walled body 12 and door 16 to effect a seal when the door 16 is closed.

According to the present invention, a bar lock mechanism or assembly, generally identified by reference numeral 30, is provided for releasably maintaining the door 16 in a closed position. As is known, the bar lock mechanism 30 is arranged for operable association with a conventional latch or clip lock 31 (FIG. 1) mounted to an outer face of the door 16. Though the bar lock mechanism 30 is shown in FIG. 1 and described in use with a single door 16, it should be understood the invention can easily and readily be adapted to multiple door closures without detracting or departing from the spirit and scope of the present invention.

Figure 2:
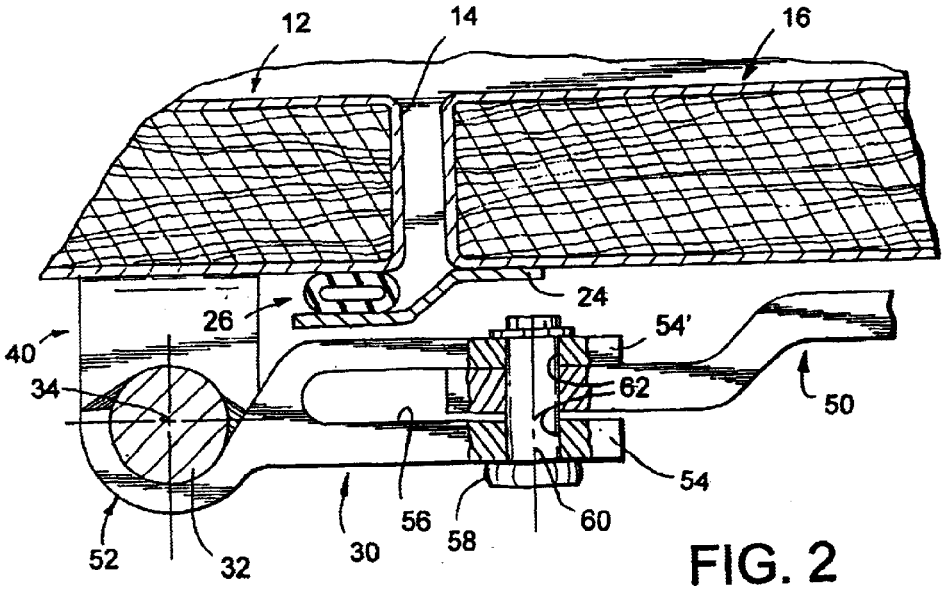
FIG. 2 is an enlarged sectional view taken along line 2—2 of FIG. 1.

As illustrated in FIGS. 1 and 2, the bar lock mechanism 30 includes an elongated member 32 preferably shaped as an elongated cylindrical shaft. It will be appreciated, however, the elongated member 32 could have cross-sectional configurations other than that illustrated for exemplary purposes without detracting or departing from the spirit and scope of the present invention. Suffice it to say, member 32 defines an elongated axis 34 extending between opposed end regions 36 and 38 and about which bar lock mechanism 30 swingably moves.

Shaft or member 32 of the bar lock mechanism 30 is adapted to be connected to the walled enclosure or container 12 adjacent and extends generally parallel to the second vertical marginal edge 23 of the opening 14 in the walled enclosure 12. That is, the elongated member 32 of mechanism 30 is adapted to be connected to the walled enclosure or container 12 adjacent to the free or non-pivoted edge of the door 16 by hinge structure 40.

As shown in FIG. 1, hinge structure 40 includes a pair of axially spaced hinge elements or pieces 42 and 42'. Preferably, the hinge elements or pieces 42, 42' are disposed toward opposed end regions 36, 38 of the elongated member 32 and, in the exemplary embodiment, are substantially identical relative to each other whereby significantly reducing inventory costs for the bar lock mechanism 30. Since the hinge elements 42, 42' are substantially identical, only hinge element 42 will be described in detail.

Each hinge element includes a base portion 44 and a mounting portion 46 preferably formed integral with the base portion 44. The base portion 44 of each hinge element is configured to allow the hinge piece or element to be secured as by suitable fasteners and/or by welding to the walled enclosure 12. In one form, the mounting portion 46 of each hinge element has a cup-like configuration. That is, the mounting portion 46 of each hinge element is configured with a blind bore or socket 48 for securing and journalling a respective end portion of the elongated member 32 for rotation about the elongated axis 34 whereby allowing the bar lock mechanism 30 to swingably move relative to the walled enclosure 12.

One end of a manually operated handle 50 is connected to member 32. The handle 50 is provided for pivoting the bar lock mechanism 30 about axis 34 and for effecting a locking action on the door 16 relative to the walled enclosure 12. In the illustrated embodiment, a bracket 52 is connected to and extends laterally from the elongated member 32. Preferably, bracket 52 has a saddle-like configuration which extends at least partially about the elongated member 32 to enhance location and securement or fastening of the bracket 52 approximately midlength of the elongated member 32. In one form, bracket 52 is securely welded to the elongated member 32. It is well within the spirit and scope of the invention, however, to otherwise secure bracket 52 to the elongated member 32 as by pinning through use of a rivet or other suitable fastener.

In the embodiment shown in FIG. 2, the free end of bracket 52 is provided with a yoke or clevis-like configuration including a pair of bifurcated arms 54 and 54'. The arms 54, 54' of bracket 52 define an open sided channel 56 therebetween. As shown, one end of the manually operated locking handle 50 fits and is secured between the joined tines 54, 54' of bracket by a pivot pin 58 defining a rotational axis 60 about which handle 50 pivots.

In the illustrated form, each arm 54, 54' of bracket 52 defines a bore or opening 62 which are aligned relative to each other along axis 60 to accommodate the pin 58 passing therethrough. As shown, axis 60, about which handle 50 pivots, extends generally normal to the axis 34 about which the bar lock mechanism 30 swingably moves. Such an arrangement allows for manual rotation of the handle or locking lever 50 in a plane extending generally parallel to the outer surface of the door 16 and into operable locking relation with the conventional latch or handle lock 31 (FIG. 1) mounted on the door 16.

In an alternative arrangement, bracket 52 could have a single apertured tine extending laterally outward from the elongated member 32. In such alternative embodiment, and without detracting or departing from the spirit and scope of the invention, the end of the locking handle 50 closest to the elongated member 32 can be provided with a yoke or clevis-like configuration which is pinned, as by pivot pin 58, to the free end of the apertured bracket 52.

Preferably, the bar lock mechanism 30 further includes compressible structure 70 arranged in laterally spaced relation from the elongated axis 34 about which the bar lock mechanism 30 swingably moves and in confronting relation relative to the outer surface of the door 16, when door 16 is in a closed position, for urging the door 16 toward the closed position. In the illustrated embodiment, a pair of brackets 72 are secured in axially spaced relation relative to each other along and laterally extend from the elongated shaft or member 32. At least one bracket 72 is preferably secured to the elongated member 32 on each vertical side of locking handle 50. Each bracket 72 is secured to the elongated member 32 in a similar manner to bracket 52, as discussed in detail above. As shown, each bracket 72 has at least one tine 74 laterally extending from the elongated member 32. Preferably, the tine 74 of each bracket 72 defines an aperture or opening 75. Suffice it to say, the brackets 72 are designed substantially identical to brackets 52 whereby reducing inventory costs for the bar lock mechanism 30.

Figure 3:
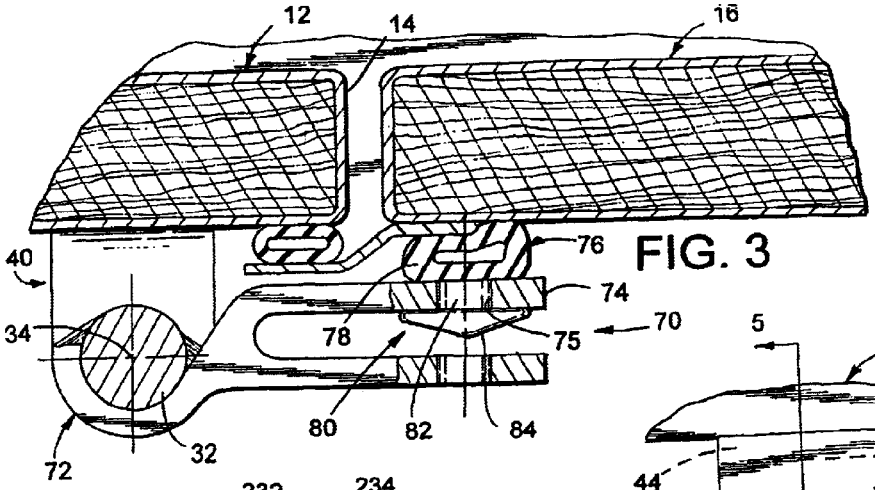
FIG. 3 is an enlarged sectional view taken along line 3—3 of FIG. 1.

In one form, structure 70 includes a compressible or resilient bumper or pad 76 suitably secured toward the free end of each bracket 72. As shown in FIG. 3, each compressible bumper 76 includes a head portion 78 which is designed to enlarge or bulge when the door 16 is in the open or unlocked position and is compressible between bracket tine 74 and the exterior surface of door 16 when door 16 is closed and the locking handle 50 is in a locked condition. As will be appreciated, when the bumpers or pads 76 are compressed, they exert an additional closing force against the door 16 and the gasket structure 26 (FIG. 2) to enhance sealing capabilities between opening 14 and the door 16.

In the example illustrated in FIG. 3, each compressible bumper or pad 76 includes a fastener or attachment portion 80 preferably formed integral with the head portion 78. The fastener or attachment portion 80 extends away from the head portion 78 and is configured to releasably attach the compressible bumper 76 to the bracket tine 74. As shown, the fastener portion 80 of each compressible button or pad 76 is designed for insertion within the aperture or opening 75 defined by each bracket tine 74.

In this embodiment, the fastener portion 80 of each bumper or pad 76 includes a shank 82 having one or more anti-retraction flexible ribs or formations 84 extending from opposite sides of the shank 82. As is known, the rib or formation 84 on the fastener portion 80 is designed to enable relatively easy deformation of the rib 84 for insertion of the fastener portion 80 of the compressible bumper or pad 76 into the opening or aperture 75 on the bracket tine 74 and, yet, relatively difficult removal of the fastener portion 80 of the compressible bumper or pad 76 from the bracket 72. Of course, and as will be appreciated, each compressible bumper or pad 76 could alternatively be configured with only the head portion 78 which can be secured to the bracket tine 74 as with a suitable adhesive and in confronting relation relative to the exterior surface of door 16 without detracting or departing from the spirit and scope of the invention.

Figure 4:
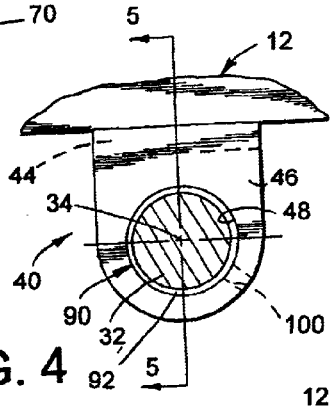
FIG. 4 is an enlarged sectional view taken along line 4—4 of FIG. 1.
Figure 5:
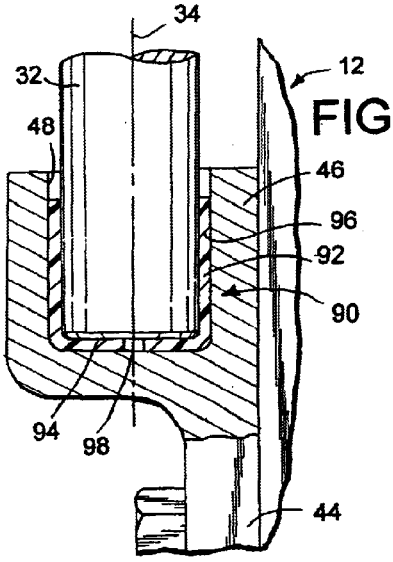
FIG. 5 is a fragmentary sectional view taken along line 5—5 of FIG. 4.

Turning to FIGS. 4 and 5, in a preferred embodiment, the bar lock mechanism 30 furthermore includes bearing structure 90 interposed between each end portion of the elongated member 32 and the respective hinge element 52 mounting the elongated member 32 for rotation. In the illustrated embodiment, bearing structure 90 includes a bearing 92 accommodated within the socket or blind bore 48 defined by the mounting portion 46 of each hinge element of hinge structure 40. In one form, each bearing 92 is formed from a non-metallic and, preferably, elastomeric material such as nylon or the like.

As shown in FIG. 5, each bearing 92 preferably has a cup-like formation and is preferably designed with a cap 94 having wall or skirt structure 96 extending therefrom and, preferably, integrally formed therewith. As shown, the wall or skirt structure 96 of each bearing 92 is adapted to be arranged about and along the elongated member 32 such that the bearing 92 is disposed between a lengthwise end portion of the elongated member 32 and the mounting portion 46 of each hinge element of hinge structure 50.

Because the bar lock mechanism 30 is exposed to the elements, bearing structure 90 preferably allows for drainage of fluids which can accumulate within the bearing structure 90 and/or mounting portion 46 of each hinge element of hinge structure 50. In the embodiment illustrated in FIG. 5, each bearing 92 is provided with a passage 98 adapted to be arranged in fluid communication with a seep hole 100 (FIG. 4) defined by the mounting portion 46 of each hinge element of hinge structure 50 so as to permit drainage of such fluids.

Figure 7:
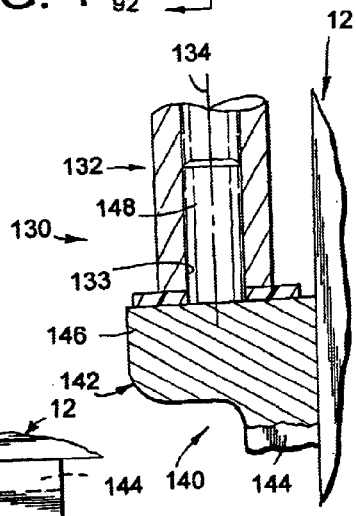
FIG. 7 is fragmentary sectional view taken along line 7—7 of FIG. 6.
Figure 6:
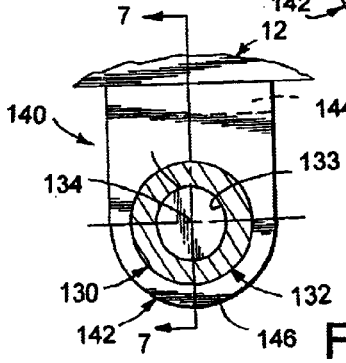
FIG. 6 shows an alternative embodiment for the bar lock mechanism.

FIGS. 6 and 7 illustrate an alternative form for the bar lock mechanism. This alternative form of mechanism is designated generally in FIGS. 6 and 7 by reference numeral 130. The elements of this alternative bar lock mechanism that are functionally analogous to those components discussed are designated by reference numerals identical to those listed above, with the exception this embodiment uses reference numerals in the one-hundred series.

In the embodiment illustrated in FIGS. 6 and 7, bar lock mechanism 130 includes an elongated member 132 which is configured as a preferably cylindrically shaped and elongated hollow tube defining an opening 133 at opposite ends thereof. A shaft or member having axially aligned blind bores or recesses opening to opposed ends of the member or shaft would, of course, equally suffice. Like member 32, member 132 defines an elongated axis 134 extending between opposed end regions of member 132 and about which bar lock mechanism 130 swingably moves.

The elongated member 132 of mechanism 130 is adapted to be connected to the walled enclosure or container 12 for oscillatory movements about axis 134 by hinge structure 140. Hinge structure 140 includes a pair of axially spaced hinge pieces or elements, with only one hinge piece 142 being shown since the other hinge piece is substantially identical thereto.

Each hinge piece includes a base portion 144 and a portion 146 integrally formed with the base portion 144. The base portion 144 is configured to allow the hinge piece or element to be secured as by suitable fasteners and/or by welding to the walled enclosure 12. In this alternative form, portion 146 of each hinge element includes a protrusion or pivot pin 148 secured thereto and extending therefrom. The protrusion or pivot pin 148 on each hinge piece or element is oriented to project into the open end or recessed portion 133 of the elongated tubular shaft or member 132 whereby securing and journalling a respective end portion and, thus, the elongated member 132 for rotation about the elongated axis 134 whereby allowing the bar lock mechanism 130 to swingably move relative to the walled enclosure 12. Like mechanism 30, the bar lock mechanism 130 can also include compressible or resilient structure similar to structure 80 for urging the door 16 toward a closed position when the bar lock mechanism is locked.

Figure 8:
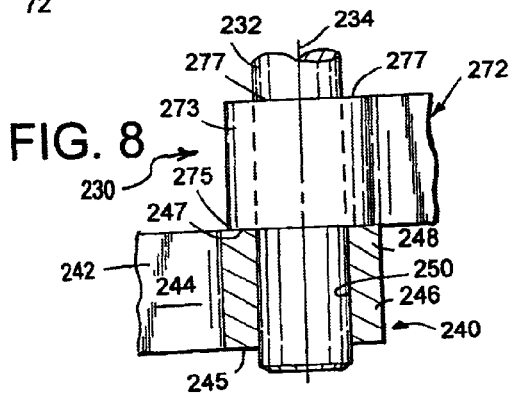
FIG. 8 shows another alternative embodiment for the bar lock mechanism.

FIG. 8 illustrates another alternative form for the bar lock mechanism. This alternative form of mechanism is designated generally in FIG. 8 by reference numeral 230. The elements of this alternative bar lock mechanism that are functionally analogous to those components discussed are designated by reference numerals identical to those listed above, with the exception this embodiment uses reference numerals in the two-hundred series.

In the embodiment illustrated in FIG. 8, bar lock mechanism 230 includes an elongated member 232 preferably configured as a cylindrically shaped and elongated shaft 132. Like member 32, member 232 defines an elongated axis 234 extending between opposed end regions of member 232 and about which bar lock mechanism 230 swingably moves.

The elongated member 232 of mechanism 230 is adapted to be connected to the walled enclosure or container 12 for oscillatory movements about axis 234 by hinge structure 240. Hinge structure 240 includes a pair of axially spaced hinge pieces or elements, with only one hinge piece 242 being shown since the other hinge piece is substantially identical thereto.

Each hinge piece or element includes a base portion 244 and a mounting portion 246 preferably formed integral with the base portion 144. The base portion 144 of each hinge element is configured to allow the hinge piece or element to be secured as by suitable fasteners and/or welding to the walled enclosure 12. In this alternative form, the mounting portion 246 of each hinge element is configured as a sleeve or collar 248 which defines a throughbore 250. Throughbore 250 is sized relative to the end portion of the elongated member 232 to be rotatably accommodated and endwise passing therethrough. Notably, the sleeve or collar 248 on the mounting portion of each hinge element includes a pair of spaced and generally parallel sides or surfaces 245 and 247 which extend generally normal to the axis 234 of the elongated member after the hinge element is secured to the walled enclosure 12.

Bar lock mechanism 230 further includes a pair of axially spaced brackets 272 which are secured along and laterally extend from the elongated shaft or member 232. As discussed above, at least one bracket 272 is secured to the elongated member 232 on each side of the locking handle (not shown) and spaced from the respective end portion of member 232. Since the brackets 272 are substantially the same, only one bracket 272 will be discussed in detail. Each bracket 272 has a saddle-like configuration 273 which extends at least partially about and along the elongated member 232 to enhance locating and securing of the bracket to the elongated member 232. In one form, each bracket 272 is welded to the elongated member 232. It is well within the spirit and scope of the invention, however, to otherwise secure bracket 272 to the elongated member 232 as by pinning through a rivet or other suitable fastener.

As shown in FIG. 8, the saddle-like configuration or mounting portion 273 of each bracket 272 has opposed and spaced sides or surfaces 275 and 277. Surfaces 275, 277 extend generally parallel to each other and generally normal to the elongated axis 234 of the elongated member 232 after each bracket 272 is secured to the elongated member 232.

When mechanism 230 is to be rotatably secured to the walled enclosure 12, the brackets 272 on the elongated member 232 are embraced on opposite sides by the hinge pieces 242 of hinge structure 240. That is, and after brackets 272 are secured to the elongated member 232, an end portion of the elongated member 232 is endwise passed through and journalled within the throughbore 250 defined by the collar or sleeve 248 of the respective hinge element 242 until the respective surfaces 245, 247 and 275, 277 of the mounting portion 246 of the hinge piece and the mounting portion 273 of the bracket 272 are arranged in abutting relation. Thereafter, an opposed end of the elongated member 232 is endwise passed through and journalled within the other hinge piece 242 of hinge structure 240 until the respective surfaces 245, 247 and 275, 277 of the mounting portion 246 of the hinge piece 242 and the saddle or mounting portion 273 of the bracket 272 are arranged in abutting relation. Thereafter, the hinge pieces 242 are secured to the walled enclosure 12 whereby axially positioning the elongated member 232 relative to the walled enclosure while permitting swinging movement of the bar lock mechanism about the axis 234 defined by the elongated member 232. Of course, and as will be understood, the hinge pieces 242 of hinge structure 240 could initially be secured to the walled enclosure 12 and thereafter the brackets 272 could be secured to the elongated member 232 to accomplish the same ends.

As will be appreciated from an understanding of this invention, the locking handle 50 connected to the elongated member 32 is used to lock the door 16 in a closed position. After the door 16 is closed, handle 50 can be moved about the pivot axis 60 of pin 58 to a position where it extends substantially normal to the axis 34 about which the bar lock mechanism swingably moves. Thereafter, locking handle 50 is manually manipulated into operable locking relation with the lock 32 on the exterior of the door 16 whereby securing the door 16 in a closed position.

In a preferred embodiment, and before handle 50 is arranged in operable locking engagement with the lock 32, the resilient structure 70 is compressed. As will be appreciated, compression of structure 70 imparts an additional closing force on the door 16 and serves to enhance the capability of the seal or gasket 26, between the door 16 and walled enclosure 12, to inhibit dirt, debris, and elements from passing therebetween and into the walled enclosure 12 through the opening 14. Thus, not only will the bar lock mechanism 30 of the present invention provide a simple and effective locking action, but such result is obtained without the necessity of providing close tolerances between the walled enclosure 12 and door 16.

Additionally, the design and configuration of the hinge structure 40 in combination with the elongated member 32 serves to eliminate parts and, thus, simplify the overall design of the bar lock mechanism 30. That is, the mounting portion 46 of each hinge piece 42 of hinge structure 40 is designed and configured to combine with the elongated member 32 to simplify the conjuncture with the walled enclosure or container 12. With the present invention, the three piece hinge normally used to swingably mount the bar lock mechanism to the walled enclosure or container has been replaced by a single hinge element 42 which combines with the elongated member 32 to swingably mount the bar lock mechanism to the walled enclosure or container. As such, the need for separate pivot pins for holding two hinge pieces in pivotal relation relative to each other has been eliminated. As will be appreciated, the likelihood for human error in inadvertently misplacing or losing the pivot pin for securing the heretofore required two hinge halves to each other has advantageously been eliminated with the present invention thereby reducing the likelihood for human error. Moreover, the need for separate strap structure for interconnecting the elongated member to such hinge structure has also been eliminated by the present invention. Unlike heretofore known designs, the elongated member 32 defines the elongated axis 34 about which the bar lock mechanism swingably moves relative to the walled enclosure or container 12. As will be appreciated from an understanding of the present invention, eliminating parts for the bar lock mechanism 30 while advantageously accomplishing the same result as with heretofore known devices advantageously results in savings in labor and, thus, overall costs.

In a preferred form, the brackets 52 and 72 used to secure the locking handle 50 and the compressible structure 70, respectively, to the elongated member 32 are substantially the same. Thus, not only will such corresponding designs result in reduced inventory costs, designing the brackets with identical designs facilitates them being welded to the elongated member 32. That is, the similarity in their design facilitates orientation of the brackets 52, 72 relative to the elongated member 32 during assembly. The similarity in the design of the brackets 52, 72 also allows similar welding techniques to be used to weld all three brackets 52, 72 to the elongated member in a single welding operation. The saddle-like configuration for mounting the brackets 52, 72 to the elongated member 32 furthermore facilitates their axial location along and securement to the elongated member 32. Furthermore, designing the brackets with identical designs facilitates their manufacture. That, by configuring the brackets 52, 72 with similar designs or profiles advantageously allows such brackets 52, 72 to be initially fabricated as a simple elongated extrusion with such brackets 52, 72 being individually cut from such extrusion as required.

From the foregoing it will be readily appreciated and observed that numerous modifications and variations can be effected without departing from the true spirit and scope of the novel concept of the present invention. It will be appreciated that the present disclosure is intended to set forth an exemplification of the present invention which is not intended to limit the invention to the specific embodiment illustrated. The disclosure is intended to cover by the appended claims all such modification and colorful variations as fall within the spirt and scope of the claims.

What is claimed is:

1. A bar lock mechanism for releasably securing a door in a closed position wherein said door extends across an opening defined by a walled enclosure, with said door being swingable about a generally vertical axis disposed adjacent a first vertical marginal edge of said opening and having a lock carried thereon, said bar lock mechanism comprising:

an elongated member defining an elongated axis extending between opposed ends thereof and about which said bar lock mechanism swingably moves, with said elongated member having a plurality of vertically spaced, free ended brackets secured thereto and radially extending from said elongated member, with each of said brackets operably extending to only one side of said elongated axis for moving into and out of operable engagement with an outer surface on said door;

a manually operated locking handle connected to said elongated member through one of said brackets disposed proximately midlength of said elongated member, with said handle being connected to said one of said brackets for rotation about an axis extending generally normal to said elongated axis whereby allowing said handle to be manipulated into an operable locking relation with said lock on said door; and hinge structure operably associated with the opposed ends of said elongated member for pivotally securing said bar lock mechanism to the walled enclosed adjacent a second vertical marginal edge of said opening, said hinge structure including a pair of axially spaced hinge pieces, with one hinge piece being disposed in operable association with each end of said elongated member, and with each hinge piece being configured to secure a respective end of said elongated member for rotation about said elongated axis whereby allowing said bar lock mechanism to swingably move toward and away from the door.

2. The bar lock mechanism according to claim 1 further including compressible structure arranged in operable association with the free end of at least two of said vertically spaced brackets and in laterally spaced relation from said elongated axis about which said bar lock mechanism swingably moves in confronting relation relative to the outer surface of the door, when said door is in the closed position, for urging said door toward said closed position.

3. The bar lock mechanism according to claim 1 wherein each hinge piece of said hinge structure includes a base portion and a mounting portion integrally interconnected to each other, with the base portion of each hinge piece being configured to facilitate mounting said hinge piece to the walled enclosure, and with said mounting portion having a cup-like configuration for rotatably accommodating one end of said elongated member.

4. The bar lock mechanism according to claim 3 further including bearing structure interposed between said elongated member and said mounting portion of each hinge piece.

5. The bar lock mechanism according to claim 1 wherein said elongated member comprises an elongated tubular shaft having open ends.

6. The bar lock mechanism according to claim 5 wherein each hinge piece of said hinge structure includes a base portion and a pin, with the base portion of each hinge piece being configured to facilitate mounting said hinge piece to the walled enclosure, and with said pin being adapted to project into the open end of said tubular shaft whereby mounting said elongated member for rotation.

7. A bar lock mechanism for releasably securing a pivoted door relative to a walled enclosure, said bar lock mechanism comprising:

an elongated shaft structure connected to said walled enclosure for rotation about an axis spaced from and extending parallel with a vertical edge of the door and arranged opposite to a pivotal axis about which door moves, with said elongated shaft structure having a plurality of vertically spaced, free ended brackets secured thereto and radially extending from said elongated shaft structure, with each of said brackets operably extending to only one side of said axis for moving into and out of operable engagement with an outer surface on said door a locking handle connected to said shaft structure through one of said brackets disposed proximately midlength of said shaft structure for rotating said shaft structure and releasably securing said door in a closed position;

and a pair of axially spaced hinge pieces disposed toward opposed ends of said shaft structure, with each hinge piece having a base portion for allowing said hinge piece to be secured to said walled enclosure and a mounting portion for journalling a respective end of said shaft structure for rotation about its axis whereby allowing said bar lock mechanism to swingably move relative to said walled enclosure.

8. The bar lock mechanism according to claim 7 further including compressible structure arranged in operable association with the free end of at least two of said vertically spaced brackets and in laterally spaced relation from and movable with said shaft structure, with said compressible structure being in confronting relation relative to the outer surface of the door, when the door is in the closed position, for urging the door toward said closed position.

9. The bar lock mechanism according to claim 7 wherein the mounting portion of each hinge piece has a cup-like configuration for accommodating a respective end of said shaft structure for rotation about its axis.

10. The bar lock mechanism according to claim 9 wherein the cup-like configuration of each hinge piece is apertured to facilitate draining of the cup-like configuration.

11. The bar lock mechanism according to claim 9 further including bearing structure interposed between the cup like configuration of each hinge piece and the shaft structure.

12. The bar lock mechanism according to claim 7 wherein said elongated shaft structure comprises an elongated tubular shaft having open ends.

13. The bar lock mechanism according to claim 12 wherein the mounting portion of each hinge piece has a pin adapted to project into the open end of said tubular shaft whereby mounting said elongated shaft structure for swinging movements.

14. A closure mechanism for releasably closing and securing a door swingably movable between open and closed positions relative to an opening in a body of a vehicle, said closure mechanism comprising:

hinge structure including a pair of axially spaced, generally coaxial pivot elements secured to the body of a vehicle adjacent a marginal edge of said opening;

an axially elongated shaft for selectively coupling said door to said pivot elements, with said shaft being mounted between and journalled for rotation by said pivot elements and defining an elongated axis about which said shaft pivots, with said elongated shaft having a plurality of vertically spaced, free ended brackets secured thereto and radially extending from said elongated shaft, with each of said brackets operably extending to only one side of said elongated axis for moving into and out of operable engagement with an outer surface on said door; and a locking handle pivotally mounted toward the free end of one of said brackets disposed proximately midlength between opposed ends of said elongated shaft for manual movement, with said handle being movable between an open position and a closed position relative to a lock mounted on said door.

15. The closure mechanism according to claim 14 further including compressible structure arranged in operable association with the free end of at least two of said vertically spaced members and in laterally spaced relation from and movable with said elongated shaft, with said compressible structure being in confronting relation relative to the outer surface of the door, when the door is in the closed position, for urging the door toward said closed position.

16. The closure mechanism according to claim 14 wherein each pivot element includes a base portion and a mounting portion, with said base portion being configured for attachment to the body of the vehicle, and with said mounting portion of the pivot element having a cup-like configuration for accommodating a respective end of said elongated shaft for rotation about the elongated axis about which said shaft pivots.

17. The closure mechanism according to claim 16 further including bearing structure operably interposed between the cup-like configuration of each pivot element and the shaft end rotatably accommodated by said cup-like configuration.

18. The closure mechanism according to claim 14 wherein said elongated shaft comprises an elongated hollow member having open ends.

19. The closure mechanism according to claim 18 wherein the mounting portion of each pivot element has a pin adapted to project into the open end of said hollow member whereby mounting said elongated shaft for rotation.

* * * * *